US010149555B2

(12) United States Patent
Collette

(10) Patent No.: US 10,149,555 B2
(45) Date of Patent: Dec. 11, 2018

(54) SHELF DIVIDER SYSTEM AND METHOD OF USING SAME

(71) Applicant: Post Consumer Brands, LLC, Lakeville, MN (US)

(72) Inventor: Stephen Robert Collette, Lakeville, MN (US)

(73) Assignee: POST CONSUMER BRANDS, LLC, Lakeville, MN (US)

( * ) Notice: Subject to any disclaimer, the term of this patent is extended or adjusted under 35 U.S.C. 154(b) by 0 days.

(21) Appl. No.: 15/882,441

(22) Filed: Jan. 29, 2018

(65) Prior Publication Data

US 2018/0146801 A1 May 31, 2018

Related U.S. Application Data

(63) Continuation of application No. 15/146,349, filed on May 4, 2016.

(51) Int. Cl.
*A47F 5/00* (2006.01)
*A47F 5/10* (2006.01)
(Continued)

(52) U.S. Cl.
CPC ..... *A47F 5/005* (2013.01); *A47F 5/105* (2013.01); *A47F 7/0071* (2013.01); *A47F 7/281* (2013.01); *G09F 3/204* (2013.01)

(58) Field of Classification Search
CPC ..... A47F 5/005; A47F 5/105; A47F 7/0071; A47F 7/281; G09F 3/204
See application file for complete search history.

(56) References Cited

U.S. PATENT DOCUMENTS 487,421 A 12/1892 Lindberg
551,642 A 12/1895 Kleine
(Continued)

FOREIGN PATENT DOCUMENTS

CN 3229435 D 3/2002
CN 2547230 Y 4/2003
(Continued)

OTHER PUBLICATIONS

Affidavit of Richard Nathan in Support of General Mills, Inc. and General Mills Sales, Inc.'s Brief (with exhibits), Case No. 17-cv-04915-JNE-TNL, 2017, pp. 1-33.
(Continued)

*Primary Examiner* — Stanton L Krycinski
(74) *Attorney, Agent, or Firm* — Thompson Coburn LLP

(57) ABSTRACT

A shelf partition has a front panel and an adjustable length side panel with first and second portions. The second portion is slidably connected with the first portion to adjust the length of the side panel between an expanded position in which the second portion overlaps some of the first portion and a retracted position in which the second portion overlaps more of the first portion. The first portion projects rearwardly from the front panel. The first portion and the second portion have opposite forward and rearward edges. The first portion forward edge is adjacent the front panel. The second portion forward edge is closer to the front panel than the second portion rearward edge. The first portion top peripheral edge has a region tapering toward the first portion rearward edge. The second portion top peripheral edge has a region tapering toward the second portion forward edge.

1 Claim, 4 Drawing Sheets

(51) Int. Cl.

| | |
|---|---|
| ***A47F 7/00*** | (2006.01) |
| ***A47F 7/28*** | (2006.01) |
| ***G09F 3/20*** | (2006.01) |

(56) References Cited

U.S. PATENT DOCUMENTS

| | | | |
|---|---|---|---|
| 560,893 | A | 5/1896 | Conant |
| 1,688,003 | A | 10/1928 | Darby |
| 1,714,266 | A | 5/1929 | Johnson |
| 1,750,576 | A | 3/1930 | Cubberley |
| 1,919,568 | A | 7/1933 | McCosh |
| 1,952,749 | A | 3/1934 | Ellis |
| 2,082,667 | A | 6/1937 | Vanderveld |
| 2,118,444 | A | 5/1938 | Mueller |
| 2,148,681 | A | 2/1939 | Cameron |
| 2,197,789 | A | 4/1940 | Dalton |
| 2,222,974 | A | 11/1940 | Wilson |
| D150,315 | S | 7/1948 | Richards |
| 2,471,977 | A | 5/1949 | Albert |
| 2,516,122 | A | 7/1950 | Hughes |
| D163,536 | S | 6/1951 | Morris |
| 2,586,925 | A | 2/1952 | Drengberg |
| 2,658,628 | A | 11/1953 | Hilgen |
| 2,743,774 | A | 5/1956 | Pinto |
| 2,845,188 | A | 7/1958 | Rosenquist |
| 2,872,046 | A | 2/1959 | Polay |
| 2,943,742 | A | 7/1960 | Colley |
| 3,002,632 | A | 10/1961 | Van |
| D194,425 | S | 1/1963 | Hungerford |
| 3,117,535 | A | 1/1964 | Hendrickson |
| D199,794 | S | 12/1964 | Lindley |
| 3,301,408 | A | 1/1967 | Craine |
| 3,304,142 | A | 2/1967 | Rockola |
| 3,308,964 | A | 3/1967 | Pistone |
| 3,329,928 | A | 7/1967 | Broske |
| 3,410,445 | A | 11/1968 | Pilley |
| 3,468,426 | A | 9/1969 | Loewy |
| 3,491,909 | A | 1/1970 | Ikelheimer |
| 3,521,808 | A | 7/1970 | Weiss |
| 3,559,815 | A | 2/1971 | Huddleston |
| 3,592,344 | A | 7/1971 | Schade |
| 3,692,191 | A | 9/1972 | Moore |
| D234,075 | S | 1/1975 | Clark |
| D236,935 | S | 9/1975 | Frazelle |
| 3,954,184 | A | 5/1976 | Mendenhall |
| D241,295 | S | 9/1976 | Entin |
| D242,198 | S | 11/1976 | Geisler |
| D246,303 | S | 11/1977 | Davis |
| D246,304 | S | 11/1977 | Horn |
| 4,111,307 | A | 9/1978 | Peggs |
| D252,436 | S | 7/1979 | Elliott |
| 4,178,047 | A | 12/1979 | Welch |
| D267,668 | S | 1/1983 | Rambusch et al. |
| 4,395,955 | A | 8/1983 | Pfeifer |
| D272,161 | S | 1/1984 | Lodge et al. |
| D274,491 | S | 7/1984 | Lietzke |
| D275,921 | S | 10/1984 | Ward |
| 4,491,137 | A | 1/1985 | Jingu |
| D279,151 | S | 6/1985 | Weiller |
| 4,595,105 | A | 6/1986 | Gold |
| D285,152 | S | 8/1986 | Smith |
| 4,618,063 | A | 10/1986 | Mendenhall |
| 4,712,694 | A | 12/1987 | Breslow |
| 4,716,841 | A | 1/1988 | Suttles |
| 4,762,235 | A | 8/1988 | Howard et al. |
| 4,765,492 | A | 8/1988 | Howard et al. |
| 4,768,661 | A | 9/1988 | Pfeifer |
| 4,792,051 | A | 12/1988 | Miller |
| 4,858,774 | A | 8/1989 | Winter et al. |
| D303,458 | S | 9/1989 | Zapf |
| 4,889,253 | A | 12/1989 | Schmulian et al. |
| 4,889,397 | A | 12/1989 | Ryan |
| D305,582 | S | 1/1990 | Zapf |
| 4,898,354 | A | 2/1990 | Whittington et al. |
| D306,670 | S | 3/1990 | Pfleuger et al. |
| 4,905,847 | A | 3/1990 | Hanson |
| D308,394 | S | 6/1990 | Smith |
| D311,469 | S | 10/1990 | Miller |
| 5,024,336 | A | 6/1991 | Spamer |
| D318,769 | S | 8/1991 | Marchiony et al. |
| 5,073,428 | A | 12/1991 | Lancelot et al. |
| D327,190 | S | 6/1992 | Wear et al. |
| D328,539 | S | 8/1992 | Waterston |
| 5,148,927 | A | 9/1992 | Gebka |
| D333,934 | S | 3/1993 | Ozawa |
| D336,933 | S | 6/1993 | Sharon et al. |
| 5,341,945 | A | 8/1994 | Gibson |
| D351,524 | S | 10/1994 | Belokin, Jr. |
| 5,432,391 | A | 7/1995 | Zawoysky |
| D365,933 | S | 1/1996 | Spielvogel |
| D369,700 | S | 5/1996 | Sandy |
| 5,582,305 | A | 12/1996 | Howell, Sr. et al. |
| D386,335 | S | 11/1997 | LaFreniere |
| 5,682,824 | A | 11/1997 | Visk |
| 5,685,664 | A | 11/1997 | Parham et al. |
| 5,695,077 | A | 12/1997 | Jay |
| D393,005 | S | 3/1998 | Devito |
| 5,803,276 | A | 9/1998 | Vogler |
| 5,855,281 | A | 1/1999 | Rabas |
| 5,926,315 | A | 7/1999 | McBride |
| 6,041,720 | A | 3/2000 | Hardy |
| 6,073,794 | A | 6/2000 | Bidot |
| 6,142,316 | A | 11/2000 | Harbour et al. |
| 6,161,320 | A | 12/2000 | Peterson |
| 6,164,215 | A | 12/2000 | Cook et al. |
| D436,772 | S | 1/2001 | Soderstrom |
| D439,084 | S | 3/2001 | Schacht et al. |
| D443,895 | S | 6/2001 | Pfanner et al. |
| D445,019 | S | 7/2001 | Vitetta |
| D445,615 | S | 7/2001 | Burke |
| 6,276,538 | B1 | 8/2001 | Battaglia et al. |
| 6,325,221 | B2 | 12/2001 | Parham |
| D453,161 | S | 1/2002 | Pentz |
| 6,341,755 | B1 | 1/2002 | Kump |
| D457,737 | S | 5/2002 | Citterio |
| D458,781 | S | 6/2002 | Cook et al. |
| D470,684 | S | 2/2003 | Beauregard |
| 6,533,131 | B2 | 3/2003 | Bada |
| D473,080 | S | 4/2003 | Kellogg |
| D479,930 | S | 9/2003 | Cook et al. |
| 6,685,037 | B1 | 2/2004 | Zadak |
| 6,691,891 | B2 | 2/2004 | Maldonado |
| D490,103 | S | 5/2004 | Rangel et al. |
| D494,394 | S | 8/2004 | Leong-Son et al. |
| D495,172 | S | 8/2004 | Brownfield et al. |
| D495,539 | S | 9/2004 | Sjoberg |
| D505,809 | S | 6/2005 | Cassidy et al. |
| D507,915 | S | 8/2005 | Nagel |
| D511,060 | S | 11/2005 | Linden |
| 6,991,307 | B2 | 1/2006 | Hoenig |
| 7,066,563 | B2 | 6/2006 | Berger |
| 7,083,054 | B2 | 8/2006 | Squitieri |
| 7,163,119 | B2 * | 1/2007 | Besselman ..... A47B 96/04 220/534 |
| D551,294 | S | 9/2007 | Goudy |
| D553,384 | S | 10/2007 | Wilenius |
| D554,912 | S | 11/2007 | Scicluna et al. |
| D564,764 | S | 3/2008 | Springer et al. |
| D566,760 | S | 4/2008 | Cristofaro |
| D568,645 | S | 5/2008 | Gore et al. |
| D569,141 | S | 5/2008 | Tobias |
| D585,215 | S | 1/2009 | Rosenberg |
| 7,478,731 | B1 | 1/2009 | Mason |
| D587,939 | S | 3/2009 | Schloss |
| D594,313 | S | 6/2009 | Clarke |
| D596,431 | S | 7/2009 | Berger |
| 7,703,866 | B2 | 4/2010 | Benz |
| D615,919 | S | 5/2010 | Bock |
| D617,125 | S | 6/2010 | Erickson |
| 7,726,057 | B2 | 6/2010 | Brinkman et al. |
| D619,393 | S | 7/2010 | Golias et al. |
| D630,087 | S | 1/2011 | Stram et al. |
| D635,379 | S | 4/2011 | Klein et al. |
| D650,596 | S | 12/2011 | Thompson |

(56) References Cited

U.S. PATENT DOCUMENTS

| | | | |
|---|---|---|---|
| D651,416 | S | 1/2012 | Martin et al. |
| 8,096,427 | B2 | 1/2012 | Hardy |
| 8,113,360 | B2 | 2/2012 | Olson |
| D657,421 | S | 4/2012 | Yan |
| D658,497 | S | 5/2012 | Paschke et al. |
| D661,112 | S | 6/2012 | Grandin et al. |
| D661,519 | S | 6/2012 | James et al. |
| D665,196 | S | 8/2012 | Plikat et al. |
| 8,276,766 | B2 | 10/2012 | Rataiczak, III et al. |
| D673,216 | S | 12/2012 | Yuan |
| D674,216 | S | 1/2013 | Erickson |
| 8,342,340 | B2 | 1/2013 | Rataiczak, III et al. |
| D679,329 | S | 4/2013 | Stravitz |
| 8,454,262 | B2 | 6/2013 | Norman |
| D690,118 | S | 9/2013 | Grandin et al. |
| D690,139 | S | 9/2013 | Trinh et al. |
| D691,402 | S | 10/2013 | Parker |
| 8,556,092 | B2 | 10/2013 | Valiulis et al. |
| D699,990 | S | 2/2014 | Martell et al. |
| D702,068 | S | 4/2014 | Mitten et al. |
| D703,744 | S | 4/2014 | Pennaz et al. |
| D717,370 | S | 11/2014 | Hammer |
| D717,573 | S | 11/2014 | Fishman et al. |
| D723,842 | S | 3/2015 | Walker |
| D726,256 | S | 4/2015 | Thomson et al. |
| D726,463 | S | 4/2015 | Andersson |
| D727,638 | S | 4/2015 | Tsuchiyama et al. |
| D730,662 | S | 6/2015 | Trinh et al. |
| 9,090,195 | B2 | 7/2015 | Peters et al. |
| 9,138,075 | B2 | 9/2015 | Hardy et al. |
| 9,173,504 | B2 | 11/2015 | Hardy |
| D754,251 | S | 4/2016 | Bigham et al. |
| D760,519 | S | 7/2016 | Le |
| D761,369 | S | 7/2016 | Elsea et al. |
| 9,392,884 | B2 | 7/2016 | Juric |
| D766,023 | S | 9/2016 | Coretti, Jr. et al. |
| D773,219 | S | 12/2016 | Clouse et al. |
| D776,298 | S | 1/2017 | Melin |
| 9,538,860 | B2 | 1/2017 | Brej et al. |
| 9,549,623 | B1 | 1/2017 | Snell et al. |
| D779,865 | S | 2/2017 | Bram |
| 9,591,923 | B2 | 3/2017 | Zeidner et al. |
| D784,746 | S | 4/2017 | Jackson |
| D784,747 | S | 4/2017 | Jackson |
| 9,642,475 | B2 | 5/2017 | Vogler et al. |
| D791,524 | S | 7/2017 | Collette et al. |
| D792,137 | S | 7/2017 | Collette |
| 9,723,934 | B2 | 8/2017 | Hardy |
| D798,091 | S | 9/2017 | Collette |
| D800,485 | S | 10/2017 | Boni |
| D803,601 | S | 11/2017 | Schalk et al. |
| D808,206 | S | 1/2018 | Zeidner et al. |
| 9,895,007 | B2 | 2/2018 | Hardy |
| D811,759 | S | 3/2018 | Woods |
| D814,216 | S | 4/2018 | French et al. |
| D815,690 | S | 4/2018 | Squillante |
| 2001/0002659 | A1 | 6/2001 | Bada |
| 2003/0010737 | A1 | 1/2003 | Lee |
| 2003/0132178 | A1 | 7/2003 | Jay et al. |
| 2003/0137227 | A1 | 7/2003 | Hoenig |
| 2003/0189018 | A1 | 10/2003 | Hopkins et al. |
| 2004/0011754 | A1 | 1/2004 | Zadak |
| 2004/0188444 | A1 | 9/2004 | Besselman |
| 2004/0211739 | A1 | 10/2004 | Lembe |
| 2005/0150847 | A1 | 7/2005 | Hawkinson |
| 2005/0178696 | A1 | 8/2005 | Van Diepen |
| 2006/0049125 | A1 | 3/2006 | Stowell |
| 2006/0075670 | A1 | 4/2006 | Brinkman |
| 2007/0175844 | A1 | 8/2007 | Schneider |
| 2009/0159763 | A1 | 6/2009 | Kim |
| 2010/0252519 | A1 | 10/2010 | Hanners et al. |
| 2011/0174750 | A1 | 7/2011 | Poulokefalos |
| 2012/0031865 | A1 | 2/2012 | Paeth |
| 2012/0111764 | A1 | 5/2012 | Lackey et al. |
| 2012/0175327 | A1 | 7/2012 | Weiher |
| 2013/0020270 | A1 | 1/2013 | Valiulis et al. |
| 2013/0112640 | A1 | 5/2013 | Desmond |
| 2014/0151313 | A1 | 6/2014 | Breslow et al. |
| 2014/0210331 | A1 | 7/2014 | Tunzi |
| 2015/0041418 | A1 | 2/2015 | Grubbs et al. |
| 2015/0225122 | A1 | 8/2015 | Jones et al. |
| 2015/0359358 | A1 | 12/2015 | Miller, Jr. et al. |
| 2016/0029794 | A1 | 2/2016 | Obitts et al. |
| 2016/0073776 | A1 | 3/2016 | Zeidner et al. |
| 2016/0242573 | A1 | 8/2016 | Colelman |
| 2017/0196355 | A1 | 7/2017 | Hardy et al. |
| 2017/0258248 | A1 | 9/2017 | Walker |
| 2017/0291555 | A1 | 10/2017 | Keezer |
| 2018/0020830 | A1 | 1/2018 | Leinonen et al. |

FOREIGN PATENT DOCUMENTS

| | | |
|---|---|---|
| CN | 3292377 D | 5/2003 |
| CN | 3292378 D | 5/2003 |
| CN | 3292379 D | 5/2003 |
| CN | 3323544 D | 9/2003 |
| CN | 2588875 Y | 12/2003 |
| DE | 40210086-0001 | 5/2003 |
| DE | 40210086-0002 | 5/2003 |
| DE | 40210086-0005 | 5/2003 |
| JP | 2015-128559 A | 7/2015 |
| TW | D133117 | 1/2010 |
| TW | M450299 U | 4/2013 |

OTHER PUBLICATIONS

Defendants' Opposition to Plaintiffs Motion for Preliminary Injunction, Case No. 17-cv-04915-JNE-TNL, dated Nov. 17, 2017, pp. 1-75.

Declaration of Huijie Shao in Support of Defendants' Opposition to Plaintiffs' Motion for Preliminary Injunction (with exhibits), Case No. 17-cv-04915-JNE-TNL, dated Nov. 17, 2017, pp. 1-127.

Declaration of Stephanie Nelson in Support of General Mills, Inc. and General Mills Sales, Inc.'s Opposition to Plantiffs Preliminary Injunction (with exhibits), Case No. 17-cv-04915-JNE-TNL, dated Nov. 17, 2017, pp. 1-202.

Declaration of Yun (Louise) Lu in Support of Defendants' Opposition to Plaintiffs' Motion for Preliminary Injunction (with exhibits), Case No. 17-cv-04915-JNE-TNL, dated Nov. 16, 2017, pp. 1-92.

Defendants' Preliminary Invalidity Contentions, Case No. 17-cv-04915-JNE-TNL, dated Nov. 8, 2017, pp. 1-22.

Defendants' Preliminary Non-Infringement Contentions, Case No. 17-cv-04915-JNE-TNL, dated Nov. 8, 2017, pp. 1-13.

Memorandum re Post Consumer Brands, LLC motion for preliminary injunction and memorandum to unseal motion, United States District Court of Minnesota, Case No. 17-cv-04915-JNE-TNL, dated Dec. 7, 2017, pp. 1-13.

Design U.S. Appl. No. 29/560,041, filed Apr. 1, 2016.

Design U.S. Appl. No. 29/617,480, filed Sep. 14, 2017.

Declaration of Shane Obitts (with exhibits), Case No. 17-cv-04915-JNE-TNL, dated Nov. 17, 2017, pp. 1-10.

Declaration of Rob Naumoski in Support of General Mills, Inc. and General Mills Sales, Inc.'s Memorandum (with exhibits), Case No. 17-cv-04915-JNE-TNL, dated Nov. 16, 2017, pp. 1-16.

Office Action for U.S. Appl. No. 29/635,169 dated Mar. 26, 2018.

Exhibits 1-7 from Videotaped Deposition of Ronald Kemnitzer in Case No. 17-cv-04915-JNE-TNL, Nov. 14, 2017.

Collette, et al., "Associated Food Trapezoid Merchandising Test", Exhibit R in Case No. 17-cv-04915-JNE-TNL, Apr. 2015, 3 pages.

Complaint, Case No. 17-cv-04915-JNE-SER, dated Sep. 26, 2017, pp. 1-20.

Declaration of Jesse R. Garcia (with exhibits), Case No. 17-cv-04915-JNE-SER, dated Sep. 27, 2017, pp. 1-148.

Declaration of Ronald Kemnitzer (with exhibits), Case No. 17-cv-04915-JNE-SER, dated Sep. 27, 2017, pp. 1-379.

Defendants' Amended Answer, Separate Defenses, and Counterclaims to Plaintiff's Complaint for Patent Infringement, Case No. 17-cv-04915-JNE-TNL, dated Apr. 13, 2018, pp. 1-14.

(56) References Cited

OTHER PUBLICATIONS

Defendants' Answer, Separate Defenses, and Counterclaims to Plaintiff's Complaint for Patent Infringement, Case No. 17-cv-04915-JNE-TNL, dated Nov. 11, 2017, pp. 1-14.
Expert Report of Paul Hatch, Exhibit A in Case No. 17-cv-04915-JNE-TNL, dated Nov. 11, 2017, pp. 1-133.
First Amended Complaint, Case No. 17-cv-04915-JNE-TNL, dated Mar. 30, 2018, pp. 1-24.
Hearing on Post's Motion for Preliminary Injunction, Powerpoint Presentation Final, Case No. 17-cv-04918, dated Dec. 1, 2017, pp. 1-34.
Hearing on Post's Motion for Preliminary Injunction, Powerpoint Presentation, Case No. 17-cv-04918, dated Dec. 1, 2017, pp. 1-43.
Memorandum in Support of Plaintiffs Motion for Preliminary Injunction, Case No. 17-cv-04915-JNE-SER, dated Sep. 27, 2017, pp. 1-43.
Plaintiff Post Consumer Brands, LLC's Answer to Defendants Amended Counterclaims, Case No. 17-cv-04915-JNE-TNL, dated Apr. 27, 2018, pp. 1-5.
Post's Reply in Support of Its Motion for Preliminary Injunction, Case No. 17-cv-04915-JNE-TNL, dated Nov. 27, 2017, pp. 1-38.
Supplemental Expert Report of Paul Hatch, Case No. 17-cv-04915-JNE-TNL, dated Nov. 30, 2017, pp. 1-14.
Transcript of Preliminary Injunction Hearing, Case No. 17-cv-04915-JNE-TNL, dated Dec. 1, 2017, pp. 1-53.
Transcript of Video Deposition of General Mills, Inc., Genral Mills Sales, Inc., and Paul D. Hatch Exhibit PP in Case No. 17-cv-04915-JNE-TNL, Nov. 22, 2017, 211 pages.
Transcript of Videotaped Deposition of Ronald Kemnitzer, Exhibit GG in Case No. 17-cv-04915-JNE-TNL, Nov. 14, 2017, 124 pages.

* cited by examiner

SHELF DIVIDER SYSTEM AND METHOD OF USING SAME

CROSS-REFERENCE TO RELATED APPLICATIONS

This application is a continuation of U.S. Ser. No. 15/146,349, filed May 4, 2016, currently pending the disclosure of which is incorporated by reference herein.

FIELD OF THE DISCLOSURE

The disclosure pertains generally to shelf partitions for displaying bagged food items. More particularly, the disclosure pertains to an L-shaped adjustable shelf partition that also serves as an advertisement fixture.

GENERAL BACKGROUND

It is becoming increasing common to package and sell particular bulk food items in plastic bags. For example, many breakfast cereals are now sold in bags rather than boxes. Other bulk food items are also sold in bags (e.g., rice). It should be appreciated that such bags of packaged food products are pliable and deformable, albeit they maintain substantial constant volume. In general, it is impractical to arrange bagged food items on a point-of-sale shelf in a manner such that particular printing on the bags face store patrons. Thus, it can be difficult for patrons to quickly discern what brand of product is provided in the bags. It is therefore common to mount partitions/dividers on shelves to separate and isolate different brands and/or sizes of bagged food items in partitioned compartments and to put other signage near each partitioned compartment for the purpose of identifying and advertisement the bagged food items. In some cases, such signage is attached to or provided on the partitions themselves. The disclosure that follows improves upon known prior art shelf partitions for bags of bulk food.

Figure 1:
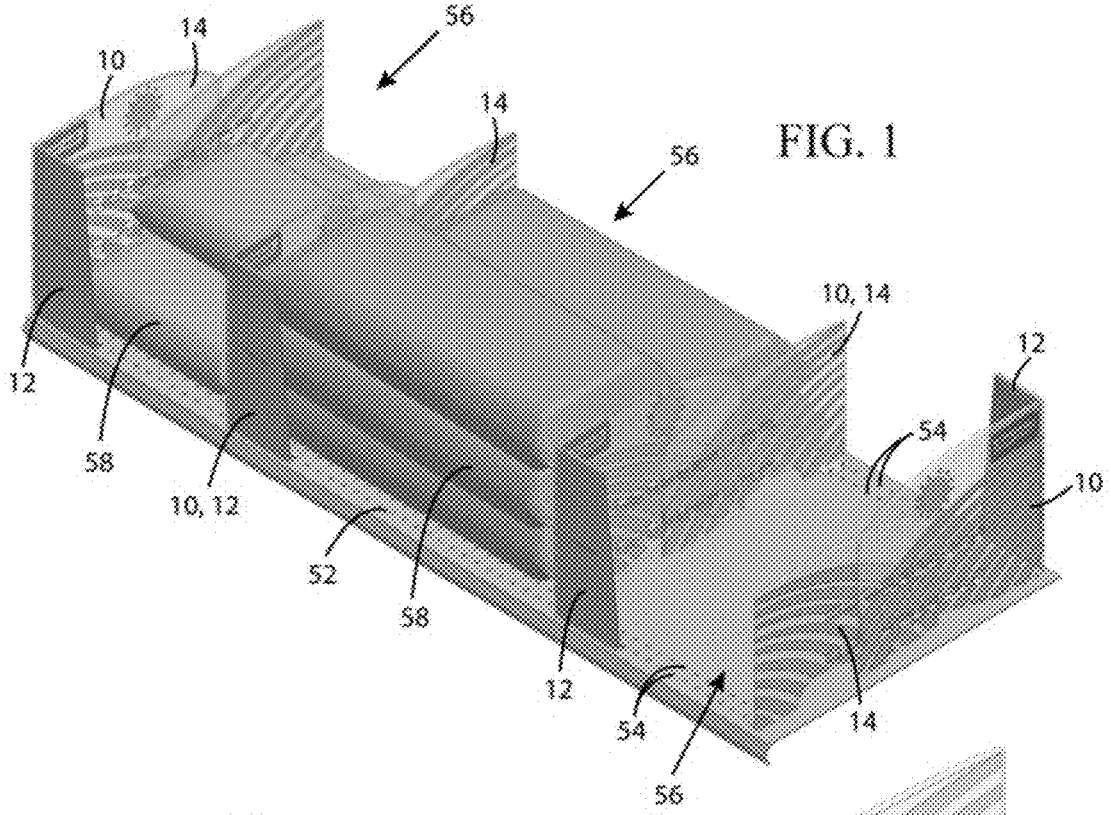
FIG. 1 depicts a perspective view of a plurality of exemplary shelf partitions attached to a point-of-sale shelf with bagged bulk food packages placed on the self therebetween.

Reference numerals in the written specification and in the drawing figures indicate corresponding items.

DETAILED DESCRIPTION

Figure 2:
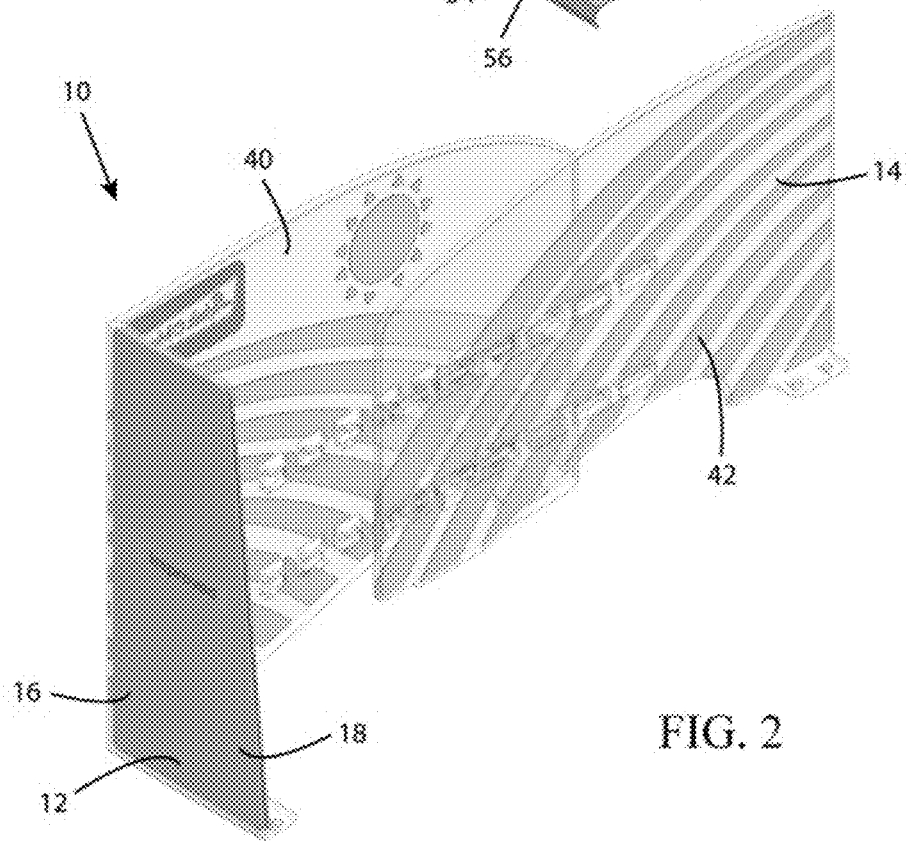
FIG. 2 depicts a perspective view of one of the shelf partitions, with the side panel of the shelf partition in an extended configuration.
Figure 3:
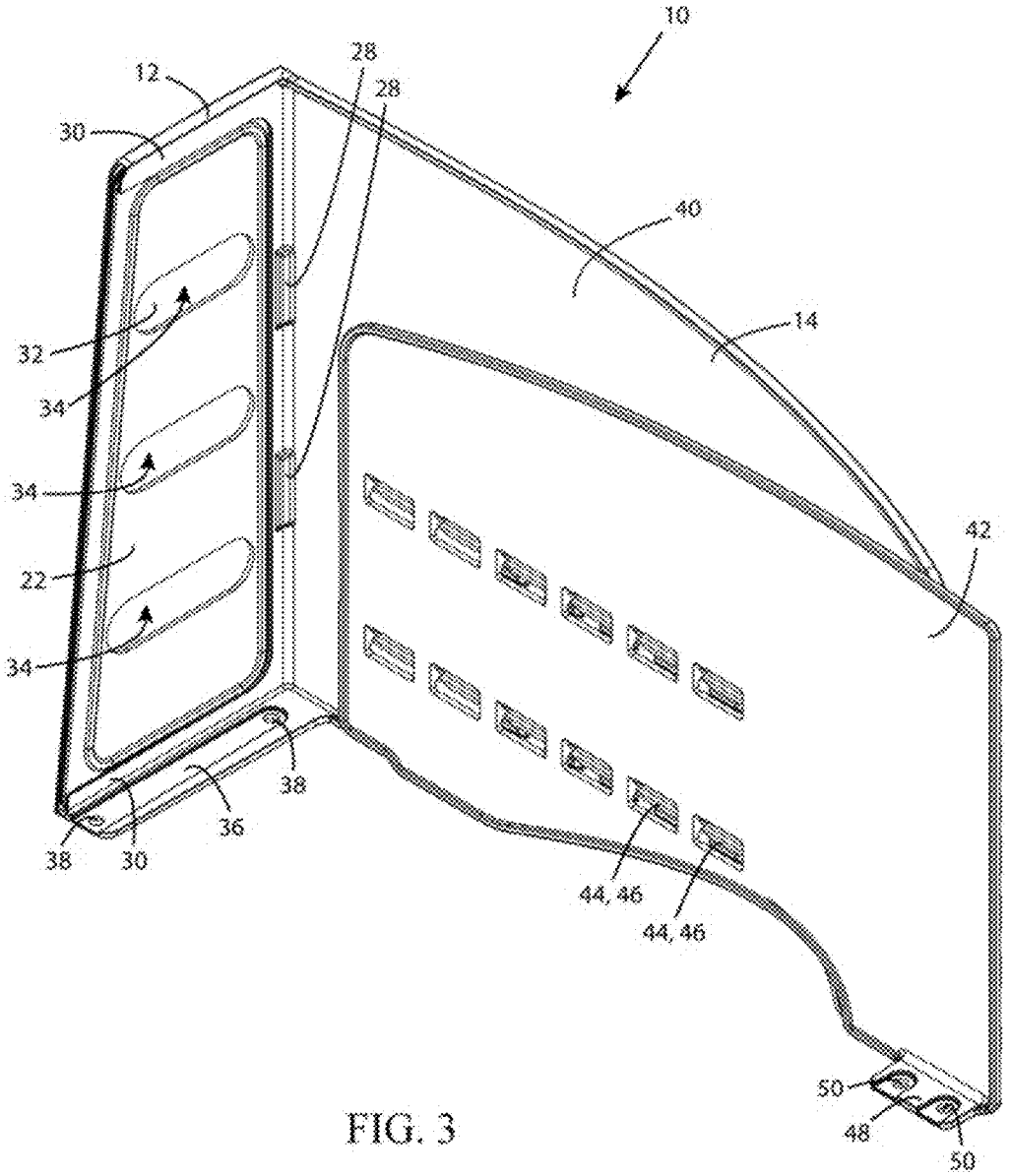
FIG. 3 depicts another perspective view of one of the shelf partitions, with the side panel of the shelf partition in an un-extended configuration.
Figure 4:
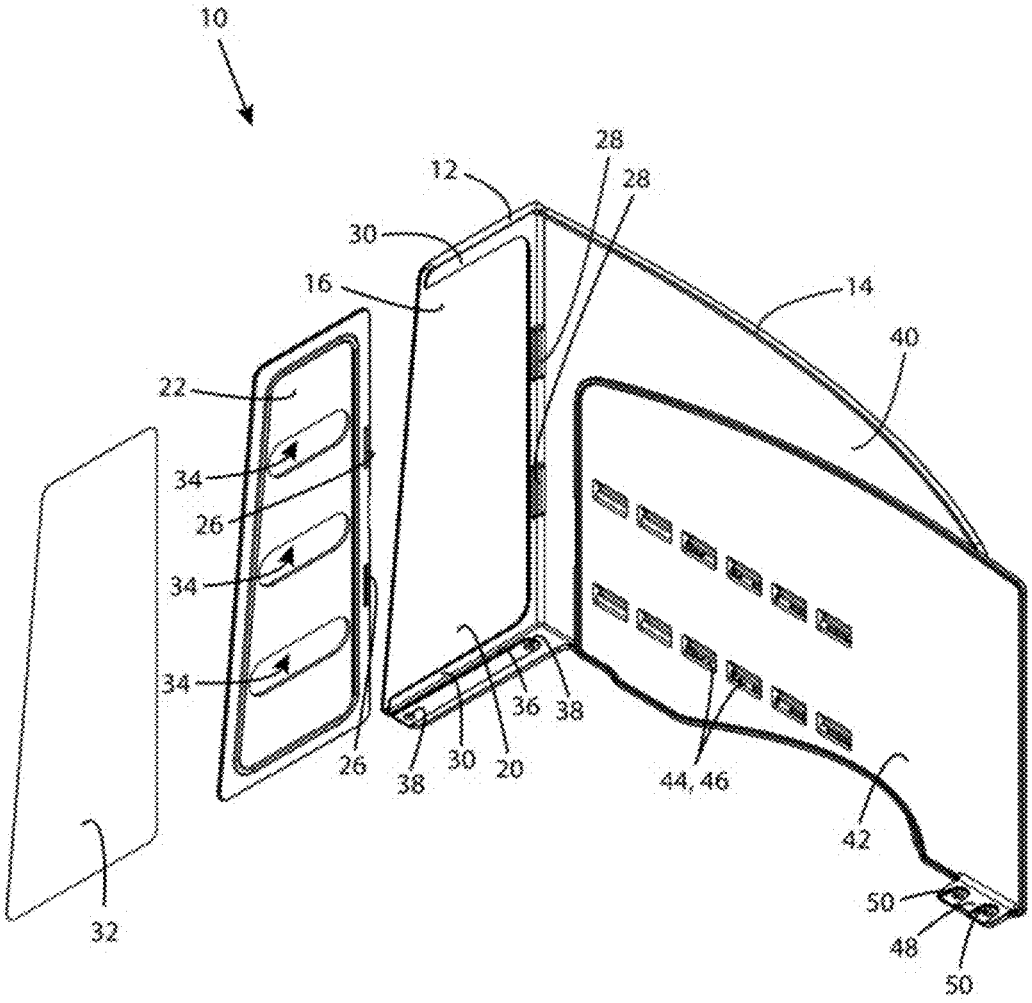
FIG. 4 depicts an exploded perspective view of the shelf partition as shown in FIG. 3, except with the support wall of its front panel and product advertisement shown detached from the shelf partition.
Figure 5:
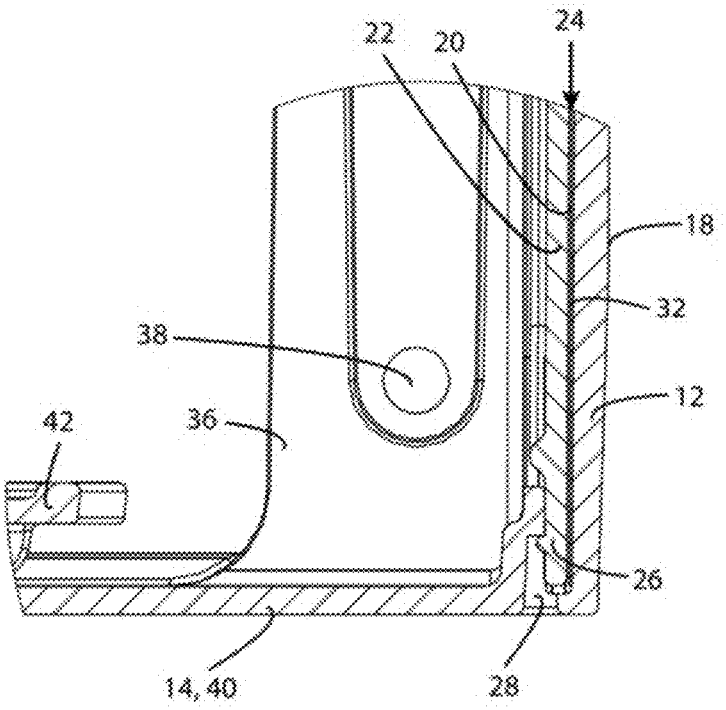
FIG. 5 depicts a detail horizontal cross-section of the shelf partition taken about a horizontal plane that intersects one of the locking formations of the support wall of the shelf partition.
Figure 6:
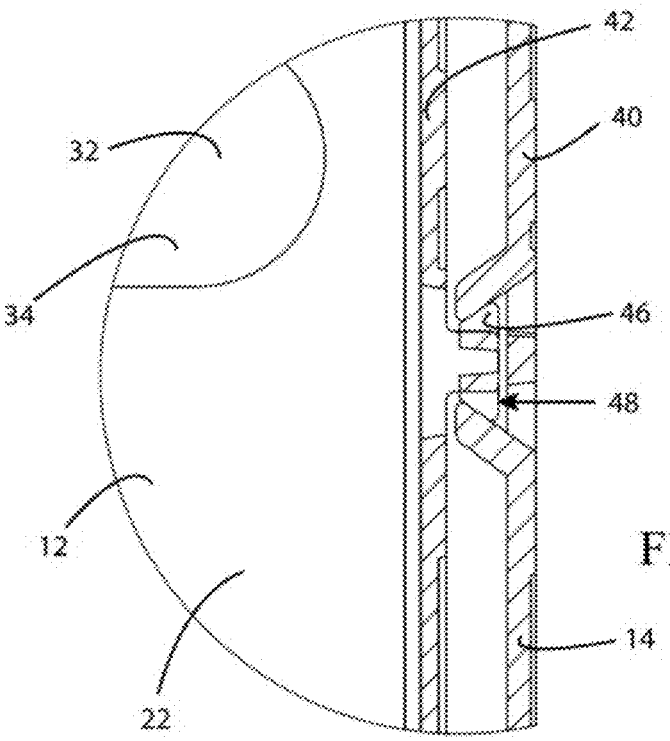
FIG. 6 depicts a detail vertical cross-section of the side panel of the shelf partition showing one set of the interlocking formations between the first and second portions of the side panel.

An exemplary embodiment of a shelf partition (10) for separating and displaying bagged bulk food on point-of-sale shelving is shown in FIGS. 2-4. The shelf partition (10) comprises a front panel (12) and an adjustable length side panel (14). The front panel (12) and the side panel (14) are connected to each other in a manner such that the shelf partition (10) is L-shaped in plan view (i.e., when viewed from directly above).

The front panel (12) comprises a translucent (and preferably transparent) front portion (16) that has a slightly convex outer surface (18). The back (20) of the front portion (16) is preferably flat. As such, the front portion (16) of the front panel (12) is configured to magnify what is behind the front portion of the front panel. The front panel (12) also comprises a support wall member (22) that that is spaced behind the front portion (16) of the front panel in a manner forming a pocket (24) between the front portion and the support wall member. The support wall member (22) is preferably formed separate from the remainder of the front panel (12) but is preferably configured to interlock with the remainder of the front panel via tabs (26) and slots (28). Once secured to the remainder of the front panel (12) via the tabs (26) and slots (28), the support wall member (22) is held generally parallel to the front portion (12) of the front panel by rails (30) that extend horizontally along the top and bottom of the front portion. The pocket (24) between the front portion (16) and the support wall member (22) of the front panel (12) is open along its rightmost end. As such, an advertisement member (32) can be slid into the pocket (24) where it will visible through the translucent front portion (16) of the front panel (12). The advertisement member (32) may be printed paper, cardboard, or any sheet material. The front portion (16) and support wall member (22) of the front panel (12), and the advertisement member (32) preferably all have generally the same perimeter shape and size. Preferably that perimeter shape is trapezoidal as shown, with horizontal top and bottom edges, a vertical left edge, and a sloped right edge. The support wall member (22) also preferably comprises at least one opening (34) that provides a finger hole to facilitate the removal of the advertisement member (32) from the pocket (24) of the front panel (12). The primary purpose of the of the support wall member (22) is to hold the advertisement member (32) against the front portion (16) of the front panel (12) and to prevent inadvertant removal of the advertisement member from the shelf partition (10) when bagged bulk food packages slide against the back of the front panel. The base of the front panel (12) also preferably comprises a support foot (36) that has a plurality of through-holes (38) that are configured to receive fasteners (not shown) for securing the shelf partition (10) to a point-of-sale shelf, as is explained in greater detail below.

The side panel (14) of the shelf partition (10) preferably comprises first (40) and second (42) portions that are slideably connected to each other in a manner allowing the length (depth) of the side panel to be adjusted prior to attaching the shelf partition to a point-of-sale shelf. The first portion (40) of the side panel (14) is preferably formed integrally with the front portion (16) of the front panel (12) as a monolithic and homogenous injection molded piece of polycarbonate. The second portion (42) of the side panel (14) is preferably interlocked to the first portion (40) of the side panel via a plurality of slots (44) and tabs (46) that prevent relative movement between the first and second portions, except for horizontal relative movent parallel to the length of the side panel. Thus, prior to being fully attached to a shelf, the length/depth of the side panel (14) can be adjusted to match the depth of the shelf. The base of the second portion (42) of the side panel also preferably comprises a support foot (48) having a plurality of through-holes (50) configured to receive fasteners (not shown) for securing the shelf partition (10) to a point-of-sale shelf. As shown in FIGS. 1 and 2, the first (40) and second (42) portions of the side panel (14), preferably have perimeters and textured surfaces that themselves may resemble the trademark(s) associated with the bagged bulk food the shelf partition (10) is configured to separate and display.

In use, shelf partitions (10) configured as described above are attached to a point-of-sale shelf (52) as shown in FIG. 1. This is done be inserting press fittings through the through-holes (38, 50) of the support feet (36, 48) of the front and side panels and into the standard holes (54) typically provided on such a point-of-sale shelf (52). The adjustability of the length of the side panel (14) of each shelf partition (10) allows the shelf partition to be set to the depth of the shelve (52) (which is typically somewhere from fourteen to twenty eight inches). As shown in FIG. 1, the front panels (12) of the shelf partitions (10) are typically oriented facing the side of the shelf that faces a store aisle. However, in situations where it is desired to store/display bagged products adjacent to a right side edge of a shelf (52), the right-most shelf partition (10) can be reversed (i.e., attached to the shelf with the front panel (12) of said shelf partition adjacent the rear of the shelf) such that the side panel (14) of the shelf partition can be in close proximity to the right edge of the shelf (as shown in FIG. 1). As is shown in FIG. 1, the shelf partitions (10) can thereby form partitioned compartments (56) for storing and displaying bags (58) of bulk food or other bagged bulk items. Preferable the shelf partitions (10) are spaced from each other along the shelf (52) in a manner such that bags (58) of bulk food or other items fit snugly between the shelf partitions. As such, the front panels (12) of the shelf partitions (10) help prevent such bags (58) from inadvertently siding off of the shelf (52). When replacing one type of bagged food products (58) with another, the spacing between the shelf partitions (10) can be adjusted (if needed) any relevant advertisement member (32) can easily and quickly be replaced by sliding the advertisement member out of the pocket (24) of the front panel (12).

Although various modifications could be made in the constructions and methods described and illustrated herein, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A shelf partition for displaying bagged bulk food items on point-of-sale shelving, the shelf partition comprising:

a transparent front panel having a pocket open on at least one side, the pocket being configured and adapted to removably receive a product advertisement, the front panel having a mounting foot projecting rearwardly from a bottom of the front panel, the mounting foot being adapted and configured to receive a fastener for securing the partition to the point-of-sale shelving; and a side panel having first and second portions, the second portion being slidably connected to and interlockable with the first portion to adjust the length of the side panel between an expanded position in which the second portion overlaps a first length of the first portion and a retracted position in which the second portion overlaps a second length of the first portion, the second length being greater than the first length, the first portion projecting rearwardly from the front panel in a manner such that the shelf partition has an "L"-shape in plan view, the first portion having opposite forward and rearward edges, the first portion forward edge being longer than the first portion rearward edge, the first portion forward edge being adjacent the front panel, the second portion having opposite forward and rearward edges, the second portion forward edge being shorter than the second portion rearward edge, the second portion having a mounting foot extending laterally from a base of the second portion adjacent the rearward edge of the second portion, the second portion mounting foot being adapted and configured to receive a fastener for securing the partition to the point-of-sale shelving, the first portion having a top peripheral edge, the first portion top peripheral edge having a region sloping downward away from the front panel, the second portion having a top peripheral edge, the second portion top peripheral edge having a region sloping downward toward the front panel, the side panel having a textured surface including at least a trademark associated with the bagged bulk food items.

* * * * *